US005253782A

United States Patent [19]

Gates et al.

[11] Patent Number: 5,253,782

[45] Date of Patent: Oct. 19, 1993

[54] ARTICLE DISPENSING APPARATUS

[75] Inventors: Lawrence B. Gates, Vernon, N.J.; Charles P. Crawley, Mentor, Ohio

[73] Assignee: Paul A. Wiebel, McAfee, N.J.

[21] Appl. No.: 886,037

[22] Filed: May 20, 1992

[51] Int. Cl.[5] ..... B65B 57/00

[52] U.S. Cl. ..... 221/15; 221/105; 221/110; 221/113; 221/121

[58] Field of Search ..... 221/15, 93, 94, 95, 221/102, 104, 105, 110, 112, 113, 121, 133

[56] References Cited

U.S. PATENT DOCUMENTS

| | | | |
|---|---|---|---|
| 844,431 | 2/1907 | Wehagen | 221/93 X |
| 1,044,591 | 11/1912 | Stocker | 221/93 X |
| 1,777,269 | 9/1930 | Webber | 221/113 |
| 2,338,335 | 1/1944 | King | 221/113 |
| 2,777,604 | 1/1957 | Welch | 221/113 |
| 3,162,287 | 12/1964 | Lupovici | 221/121 X |
| 3,179,289 | 4/1965 | Moyer et al. | 221/121 |
| 3,722,739 | 3/1973 | Blumberg | 221/15 |
| 4,872,591 | 10/1989 | Konopka | 221/15 X |
| 5,127,544 | 7/1992 | Robinson et al. | 221/93 |
| 5,152,422 | 10/1992 | Springer | 221/15 X |

*Primary Examiner*—Robert P. Olszewski
*Assistant Examiner*—Dean A. Reichard

[57] ABSTRACT

An article dispensing apparatus which comprises a frame having a protective housing mounted thereon and a rotatable turret having a plurality of vertical channels circumferentially arranged about the axis of the turret, each channel holding a stack of articles. A hand-operated handle is mounted on the frame, and means operated by the handle rotates the turret a partial turn to bring a channel into register with an outlet for discharging the article. A reciprocating ram means is operable by the handle to push the bottom article from the channel into the outlet.

10 Claims, 14 Drawing Sheets

ARTICLE DISPENSING APPARATUS

FIELD OF THE INVENTION

The present invention relates generally to a dispensing apparatus and is particularly related to a dispensing apparatus for dispensing merchandise contained in sample packages. More specifically, this invention relates to an apparatus for dispensing packaged free sample packages individually, and which comprises a customer operated handle and a time lag means, for dispensing each package at a predetermined time interval after dispensing the prior package.

BACKGROUND OF THE INVENTION

Dispensing and vending machines have been used, and are presently used in merchandising a variety of articles which include beverages, medicinal products, different foods and snacks, and a host of other packaged goods. Indeed the use of such machines is a matter of common experience and affords a convenient alternative to over-the-counter sales of products or hand and mail delivery of samples for the advertising and marketing of different goods to consumers.

In one vending machine described in U.S. Pat. No. 3,179,289, the merchandise packages to be sold to customers are stacked within a plurality of vertical compartments each having a bottom opening. These compartments are peripherally arranged around a rotatable column, and the columns are rotatable to successively bring each column into register with a package release element. Activation of the release element permits the lowermost package in the registered compartment to fall through the opening of said compartment.

U.S. Pat. No. 3,706,395 describes another dispenser for dispensing small articles, such as tablets, in preset quantities. The dispenser comprises a plurality of radially arranged storage containers for storage of the tablets, in bulk, in individualized plastic tube-type containers. The entire dispenser assembly is rotatable so that when one container has been emptied the next radially adjacent container is moved into position to dispense additional tablets.

U.S. Pat. No. 4,807,780 describes a beverage vending machine for dispensing cups containing ingredients which require only the addition of water and possibly sugar. The machine includes a turret mechanism which has radially arranged magazines adapted to hold a plurality of columns of pre-packed plastic cups. The columns are rotatable about a vertical axis as each column is emptied.

The aforementioned patents represent a few of the variety of vending and dispensing machines which are described in different patents. Other machines are described in U.S. Pat. Nos. 2,093,410; 2,268,688; 2,290,275; 2,556,852; 2,720,336; 3,209,945; 3,266,642; 3,756,362; 4,069,943; 4,978,032; and 5,080,257.

SUMMARY OF THE INVENTION

This invention provides an article dispensing apparatus which may be used for dispensing relatively small packages of packaged products, and thus provides a convenient means of marketing and advertising new products. In its broadest aspect, the apparatus of this invention comprises a housing mounted upon a frame and divided into upper and lower chambers. A turret is mounted on a turret base plate in the upper chamber, said turret having an axis rotatably mounted on the housing frame and includes a plurality of vertically aligned channels circumferentially arranged about said axis. Each channel is open at its bottom and is adapted to hold a vertical stack of packaged samples. A hand-operated handle is mounted on the frame and is operatively connected to the turret to rotate the turret a partial turn each time the hand-operated handle is pulled down by the consumer. Sample ejection ram means are reciprocally mounted on the turret base plate and reciprocate upon operation of the handle to eject the bottom sample from the channel. The sample is ejected onto a chute and into a sample receptacle underneath the chute, from where the sample can be retrieved by the consumer.

In one particular aspect, the apparatus comprises a time delay means which delays the return of the hand-operated handle to its initial position in order to provide a predetermined time delay between dispensing of each sample.

BRIEF DESCRIPTION OF THE DRAWINGS

In the drawings, wherein like reference numerals designate like parts.

DETAILED DESCRIPTION OF THE INVENTION

Figure 2:
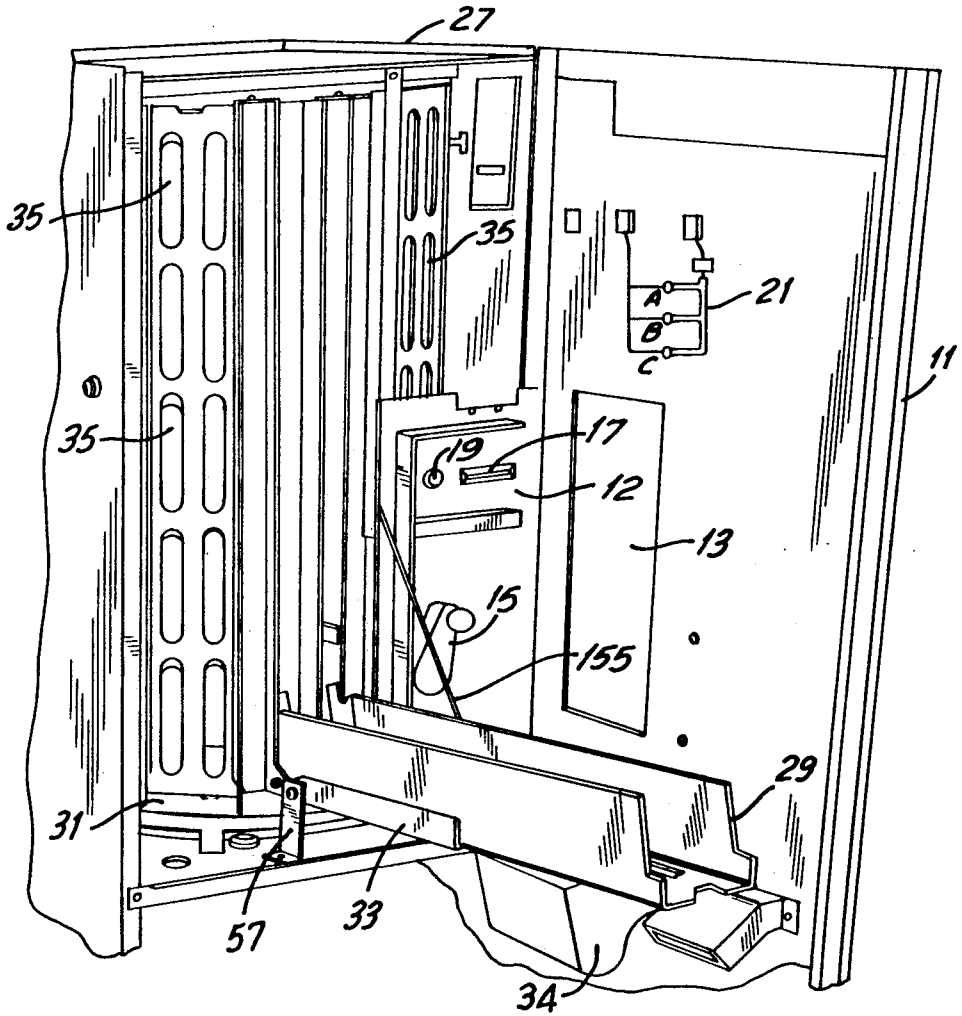
FIG. 2 is an elevational perspective interior view of the upper section of the apparatus of this invention showing the turret assembly partly exposed, and one sample storage chute pivoted to its horizontal loading position.
Figure 1:
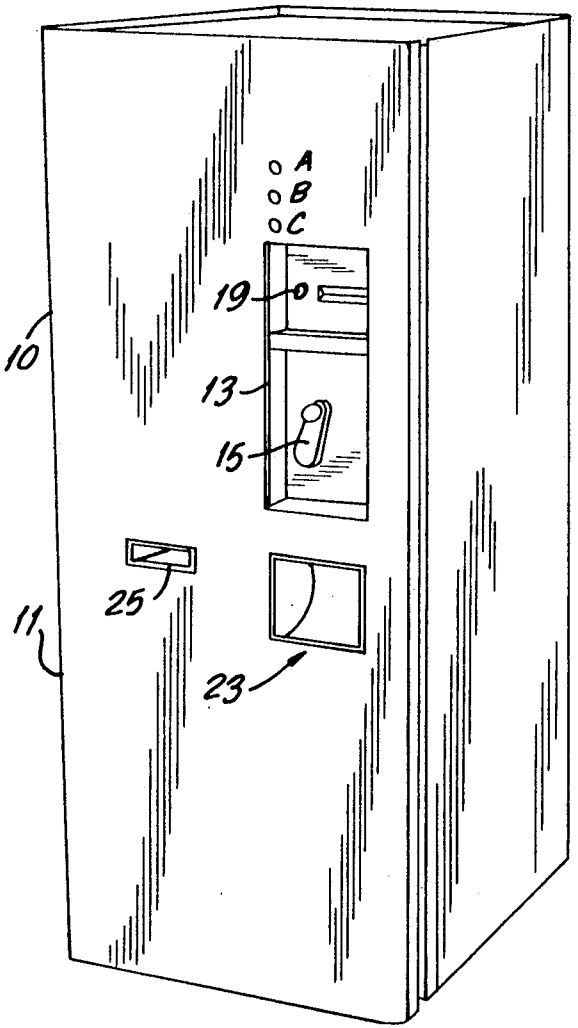
FIG. 1 is an elevational perspective exterior view of the apparatus of this invention.

Referring to FIG. 1, the apparatus of this invention is in the general form of an upstanding housing designated as 10 and comprises a front swing door 11 which swings open as shown in FIG. 2.

Typically, the apparatus of this invention may be 5 ft. high, 20 inches wide and 2 ft. deep although the exact dimensions are not per se critical. It comprises an upper section comprising a turret assembly and a lower section comprising a cam assembly and its associated cable mechanism, as hereinafter described. The apparatus will be described for dispensing free samples of small 3×3 inch packages which may contain cookies, crackers, medicinal or other products which are generally packaged in such small packages.

The swing door 11 has a generally rectangular opening 13 for access to a control panel 12 on which is mounted an operating handle 15, whose function will be described hereinafter. Visible through the opening 13 above the handle 15 is an elongated coupon dispensing slot 17 and a coupon push button 19 which, in the coupon dispensing mode, (when the apparatus is empty of sample packages) can be pushed to dispense redemption coupons through the slot 17. A conventional coupon dispensing machine may be employed.

Also shown on the swing door 11, above the rectangular opening 13, are three electronically lighted push buttons A, B and C. When push button A is illuminated, the apparatus is in the package dispensing mode. Illumination of push button B indicates that the machine is in the loading mode and illumination of push button C indicates that the apparatus is empty. When the apparatus is empty, push button 19 may be activated to dispense redeemable coupons. The push buttons A, B, and C are installed within the electronic circuit 21 as shown in FIG. 2. The coupon dispensing mechanism constitutes an optional feature of the apparatus of this invention and its inclusion is not necessary.

As is further shown in FIG. 1, the swing door 11 contains an access opening 23 for the removal of each sample that is dispensed into the sample receiving chute or compartment 24. For example, below the opening 23 may state "Take free sample here." A slot 25 in the swing door 11 is for waste so that users may insert empty packages into the lower housing compartment after their contents have been removed.

Figure 3:
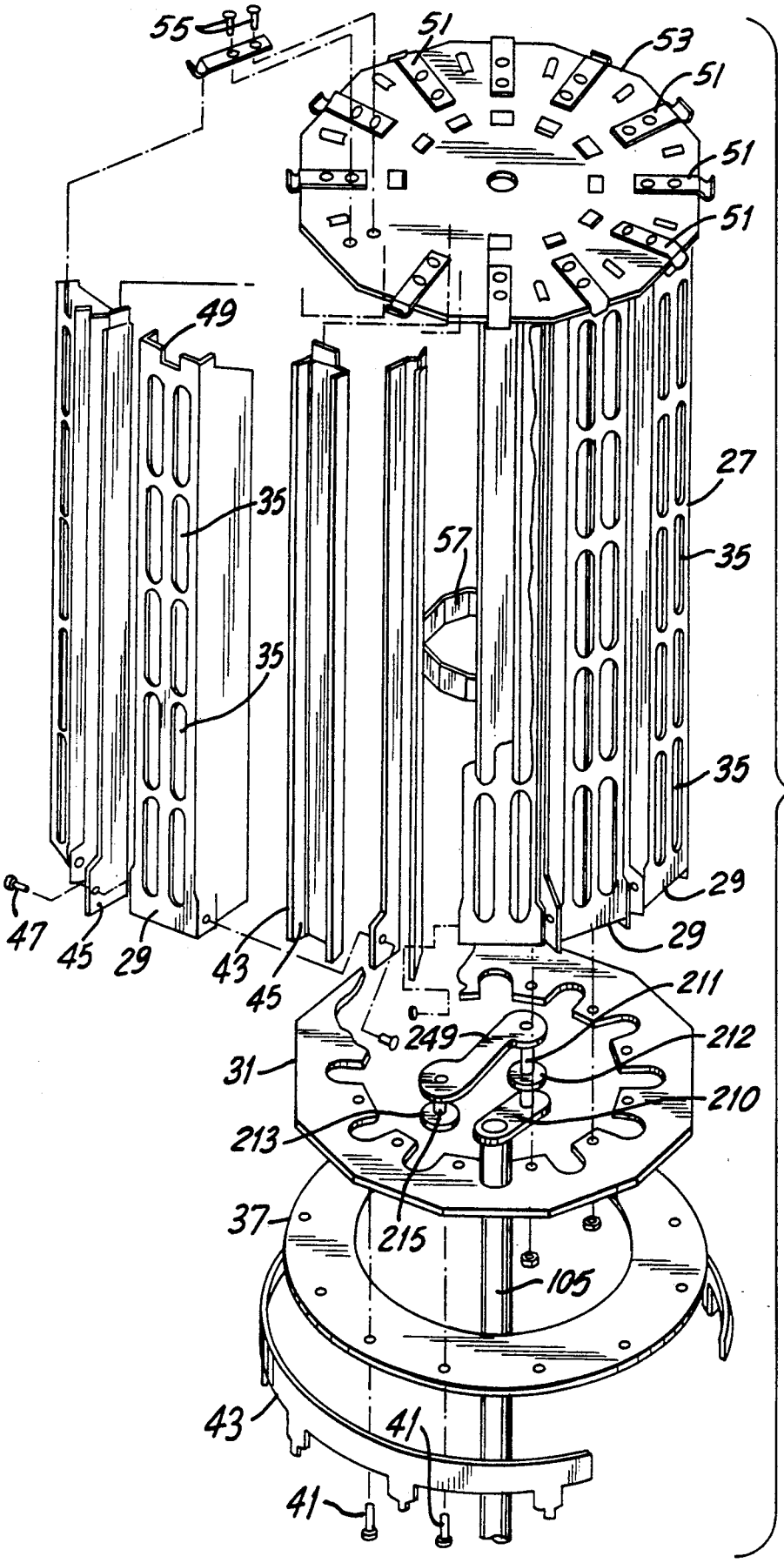
FIG. 3 is an exploded perspective view of the turret assembly.

FIGS. 2 and 3 show the turret assembly 27 comprising a plurality of vertical sample-containing chutes 29 circumferentially arranged, preferably equidistantly, about the turret base plate 31. In a typical embodiment, the turret assembly 27 has 12 chutes, with each chute being sized to normally store 33 vertically loaded sample packages. FIG. 2 illustrates one chute 29 opened to its full horizontal position, with the chute being nested within the elongated chute receiving channel 33, in order to load the chute 29 with the sample packages. Each chute 29 is provided with a plurality of vertical slots 35 to observe the level to which the chute is packed with the packages, and has a bottom opening through which the package may drop freely.

As shown in FIG. 3, the turret support plate 31 is fixed to the lower turret wheel 37. The turret support plate 31 and the lower turret wheel 37 are aligned and secured to one another by a plurality of threaded screws 41, or by some other suitable means. The shaft 105 extends through the turret base plate 31 and the turret wheel 37 and is secured (e.g. by welding) to a primary crankshaft 210 which has a primary orbiting shaft 211 secured thereto and spaced apart from the shaft 105. The driving wheel 212 engages a right side slot (not shown) on the turret support plate 31, and as the shaft turns 180 degrees it will advance the turret until said slot assumes the position of the next adjacent slot (see also FIGS. 9A–9D and FIG. 12). The turret now will have rotated 30 degrees clockwise.

Once again referring to FIG. 3, there is shown the cross link generally peanut shaped member 249 secured (e.g. welded) at one end to the top of the primary orbiting shaft 211, and the other end is secured to the secondary orbiting shaft 215 which engages the driving wheel 213. The operation of member 249 will be described in more detail in connection with description of FIG. 12.

A sample containment channel 43, which is U shaped in cross-section is positioned behind each of the chutes 29. The sample containment channel 43 serves as the back wall of the chute 29 when the chute 29 is in its normal vertical position. Also the channel 43 spaces the support plate 31 from the turret top plate 53.

At their lower ends, each pair of adjacent chutes 29 is rigidly secured by an intermediate vertical structural channel 45 by means of the threaded screws 47. At the upper end, each of the chutes 29 has a central recess 49 adapted to releasably engage one end of the spring clip 51 which snaps into the recess. The other (horizontal) end of the clip 51 is affixed to the top surface of the turret top plate 53 by means of the rivets 55. The clips 51 are arranged circumferentially about the turret top plate 53 as shown in FIG. 3 so as to snap into the respective recesses of the sample-containing chutes 29. By simply pushing the end of the clip 51 upward with the thumb, the chute is freed to pivot downward and drop to a horizontal position, as shown in FIG. 2. The chute 29 may be lowered by service personnel when it needs to be refilled with a fresh supply of sample packages. As shown in FIG. 2, the chute receiving channel 33 is pivoted to the turret base plate 31 by means of an L-shaped brackets 57 and is held at about horizontal position, when released, by a link chain (not shown).

A turret central plate 57 is affixed (e.g., tab locked) to the chutes as shown in FIG. 3 in order to provide increased mechanical integrity to the turret assembly.

Figure 4:
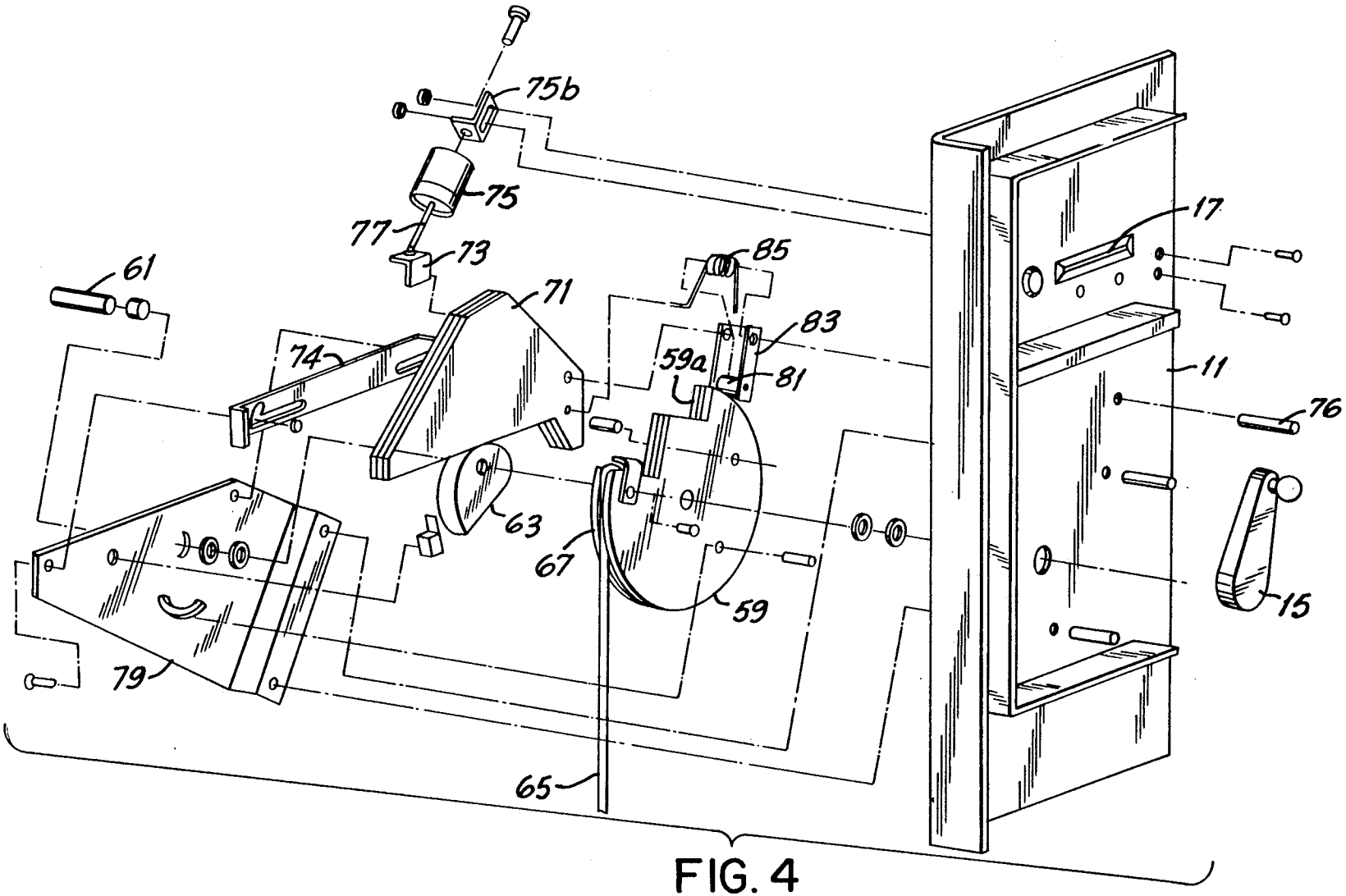
FIG. 4 is an exploded perspective view of the control panel of the apparatus of this invention and the handle-operated turret activating mechanism and timer associated with said panel.

Looking at the rear of the control panel 12, there is shown in FIG. 4 the pulley or sear plate 59 which is coupled to and is activated by the operating handle 15 through the central shaft 61 which also extends through the cam 63. A cable 65 extends from the circumferential groove 67 of the pulley 59 and over the cable spool 69 (see also FIG. 5) in the lower housing of the dispensing apparatus as will hereinafter be described. As the operating handle 15 is pushed down by the user, both the pulley 59 and the cam 63 will be turned by the central shaft 61 causing the adjacent pivot weight plate 71 to fall as it is no longer held upward by the cam 63. As is also shown in FIG. 4, the pivot weight plate 71 rotates on the support bracket 79. A roller 81 is held by means of pivotable bracket 83 against the pulley 59 by the spring 85 between the weight plate 71 and the pivotable bracket 83. After the operating handle 15 is pushed down to its lowermost position, the roller 81 engages the recessed surface 59*a* of the pulley 59 and holds the handle 15 in that position for a predetermined time, usually about 30 seconds. When the weight plate 71 returns to its previous down position, it disengages the roller 81 off the plate 59 and allows the handle 15 to return to its initial position. Ordinarily this weight plate 71 has a tendency to immediately drop back to its initial position, thus reversing the direction of rotation of the cam 63 and the plate 59 and raising the operating handle 15 to its initial position. However, in order to delay the return of the operating handle 15, and hence delay the time for dispensing the next sample package (as will hereinafter be seen in connection with FIGS. 11A through 11D). The pivot weight plate 71 is attached by means of the L-shaped bracket 73 to the air pot 75 which has a central reciprocating shaft 77. The shaft 77 is secured at its lower end to the L-shaped bracket 73. At its upper end, the air pot 75 is bolted to the control panel 12 by the L-shaped bracket 75*b*. Air pot 75 serves to retard the pivot weight plate 71 from returning to its initial position until a predetermined time, usually 25–30 seconds, has elapsed.

The weight plate 71 is secured to a timer by pass plate member 74 by the pivot pin 76 such that when the plate member 74 is pushed to the right, the pivotable bracket 83 will be prevented from engaging the recessed surface 59*a* of the pulley 59. Therefore when the operating handle 15 is pulled down and the plate member 74 is pushed to the right, the operating handle 15 will return quickly to its initial position without time delay. Thus the time by pass mechanism allows quick loading and unloading of the chutes when desired.

Figure 6:
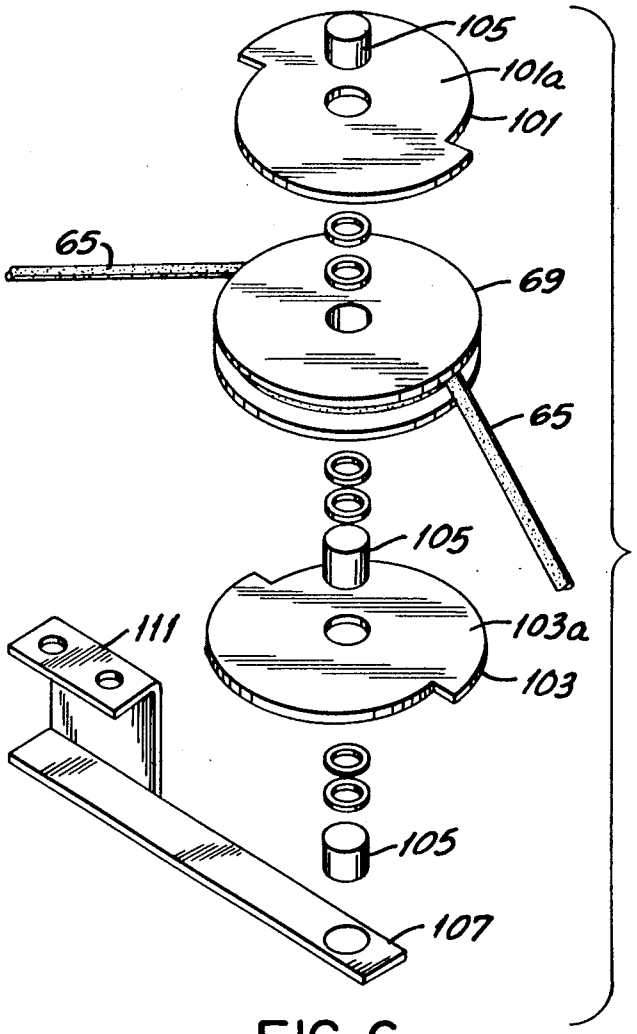
FIG. 6 is an enlarged exploded, perspective view of the cam assembly and its associated cable wheel mechanism.
Figure 5:
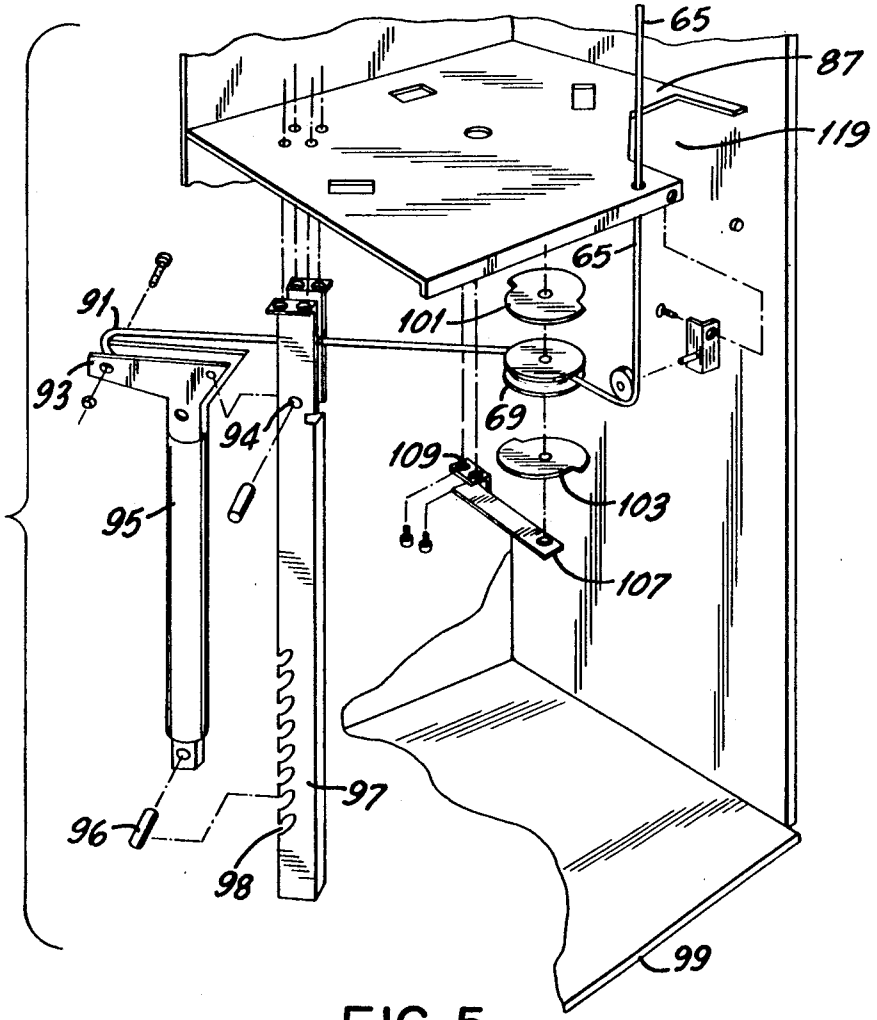
FIG. 5 is an exploded, perspective view of the lower interior of the apparatus of this invention showing the cam assembly and the cable mechanism used to rotate the cams.

Referring to FIGS. 5 and 6, the cable 65 from the pulley 59 extends down through the turret support table 87, then partly around an adjustable idler pulley 89 and the cable spool 69, extending to and terminating at 91 where the cable 65 is looped around the bolt 92 of the pivot rocker arm 93. Rocker arm 93 pivots on a pin 94 in the support stanchion 97. The rocker arm 93 is pivotly secured to shaft 250 (see FIG. 12) of cylinder 95 which is held within the support stanchion 97 and is fixed at its top end by bolting it to support table 87. The stanchion 97 may be additionally secured to the lower interior walls of the apparatus by means of side bars or braces (not shown). The tension on the cable 65 may be adjusted by removal of pin 96 from a pair of slots 98 of the support stanchion and placing it into an alternative pair of slots (only one slot of the pair being visible in FIG. 5). Inside the cylinder 95 is a hydraulic damping device which is adjustable to vary the return speed of shaft 250.

Figure 7:
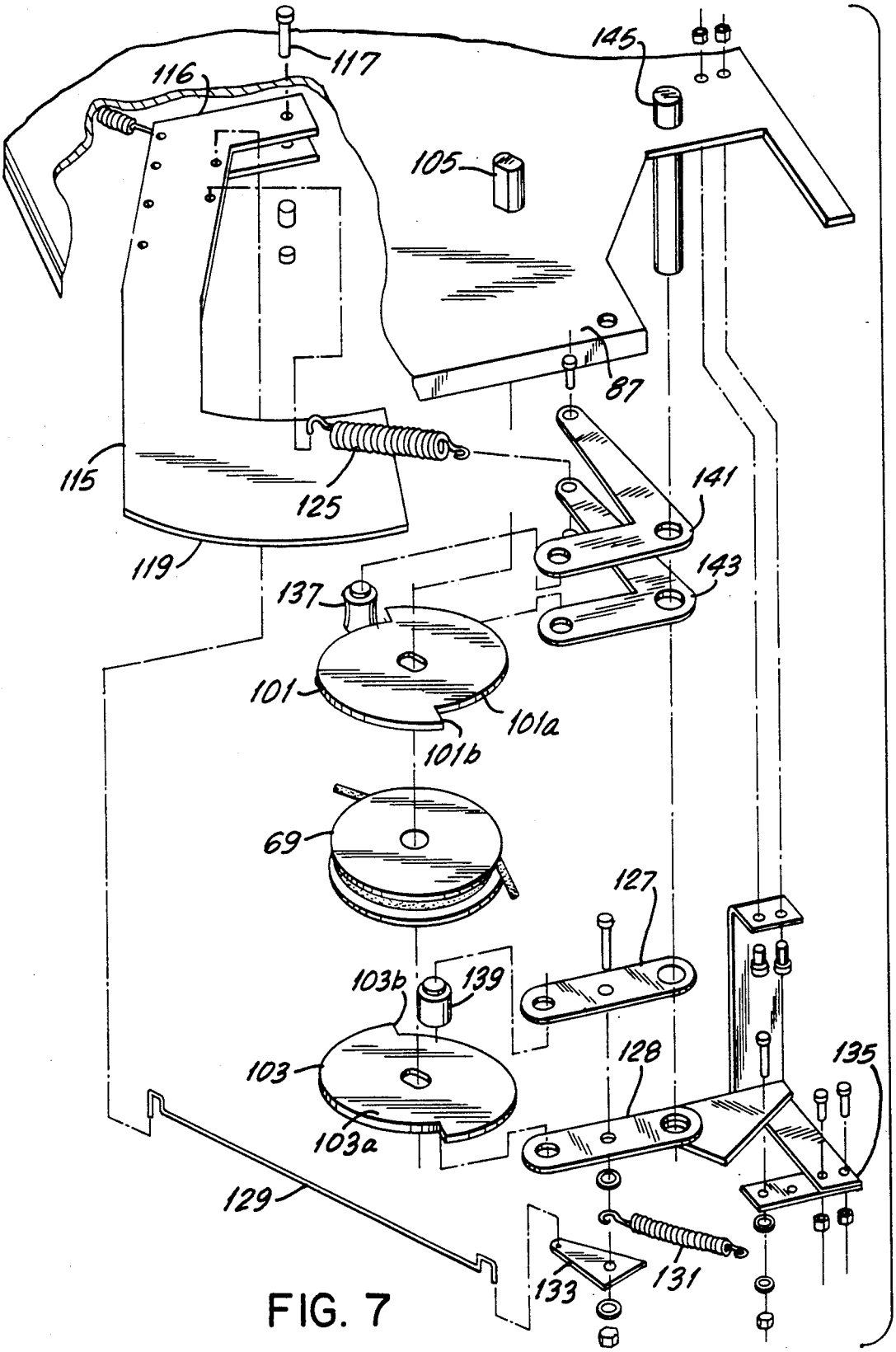
FIG. 7 is an exploded, perspective view of the trap door activation mechanism, the cam assembly and their associated elements.

The cable spool 69 is ratchetted to a pair of cams, i.e., an upper cam 101 and a lower cam 103, and may rotate and slide on shaft 105. The cams 101 and 103 have central aligned openings through which extends the central shaft 105 and are fixed to the shaft 105 which is free to rotate in the bracket 107 and the turret support table 87. The cams 101, 103 also rotate with the shaft 105 by the ratchet mechanism between the spool 69 and cam 103. The ratchet engages every 180 degrees to rotate the cams and shafts clockwise, while the spool 69 may oscillate clockwise to turn the cams and counterclockwise to engage the next tooth of the ratchet. The bracket 107 has an L-shaped portion 109 which is secured to the turret support 87 as at 111 (see FIG. 7). The turret support table 87 also serves to partition the upper chamber from the lower chamber of the apparatus. As seen in FIG. 7, the coil spring 131 is retained at one end to the plate 133 and at the other end to the bracket member 135. The bracket member 135 is bolted to the turret table 87. A return coil spring 132 is connected at one end to turret table 87 and is connected at its opposite end to door 115 to normally urge the door 115 in a clockwise (open) direction.

Underneath the turret table 87 there is shown, in FIG. 7, the pivotable trap door 115 having one arm 116 pivotally attached to the turret table by means of the pivot bolt 117, and a swing arm 119 which is operative to swing back and forth. The arm 119 opens and closes the opening 121 in the turret support table 87, through which opening the sample packages drop into the sample receiving chute 24 for removal by the user (see FIGS. 2 and 8). Alternatively, and not shown, a side chute may lead from the side to opening 121, which permits the sample to be ejected onto the trap door arm 119 instead of directly through the opening 121. The trap door 115 is attached to one end of a heavy coil spring 125, the other end of the coil spring 125 being connected to the pivotable trap door closer levers 143 and 141 by means of a nut and bolt 143*b*. The spring wire link 129 has one end secured to the arm 116 of the swing door 115 and the other end hooked onto the plate 133. The wire link 129 serves to pull the positive stop plates 127, 128 with the cam follower roller 139 away from the step in portion 103*b* of cam 103 whenever the trap door 115 is open. This allows the vend cycle to begin.

Also shown in FIG. 7 are the pair of cams 101 and 103 with their respective cam follower rollers 137 and 139. The pair of levers 141 and 143 and the positive stop plates 127, 128 rotatably mount the cam rollers 137 and 139, respectively. The cam roller 137 is rotatably mounted in one end between the levers 141, 143 whereas the cam roller 139 is rotatably mounted between the positive stop plates 127, 128. The pivoting points of each of the levers 141 and 143, and the positive stop plates 127, 128 are rotatably mounted on the stationery pin 145 which is fixed on the turret plate 87. The levers 141, 143 will rotate freely clockwise when the cam 101 is rotated in response to the activation of the door handle 15 and the cam roller 137 rides up the lobe of cam 101 connecting spring 125 thereby closing the trap door 115. Cam 103 rotates as well and the step in portion 103*b* moves past stop roller 139 before trap door 115 has closed, and spring 131 causes the positive plates 127 and 128 to rotate counterclockwise so roller 139 will ride down the lobe of cam 103 until the roller contacts the face of step in 103*b* thereby stopping all rotation of the cams 101, 103, respectively, and ceasing further rotation of the turret. At this point roller 137 drops off step in cam 101*b* and spring 132 opens trap door 115. The system will then return to the initial cycle.

Figure 8:
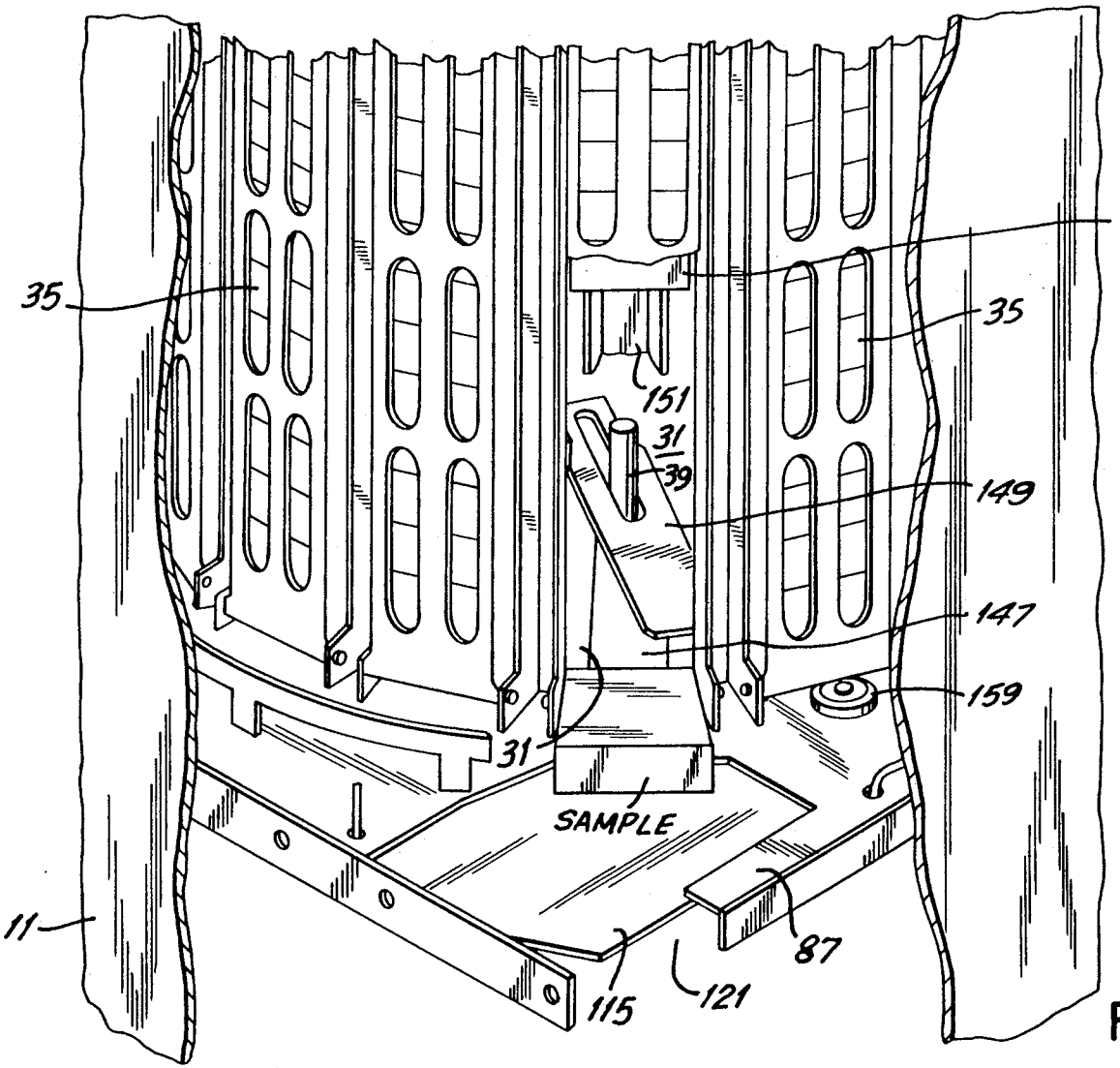
FIG. 8 is a front elevational, perspective view showing the turret assembly and the reciprocating rams used to push the sample onto the trap door located beneath the turret table.
Figure 13:
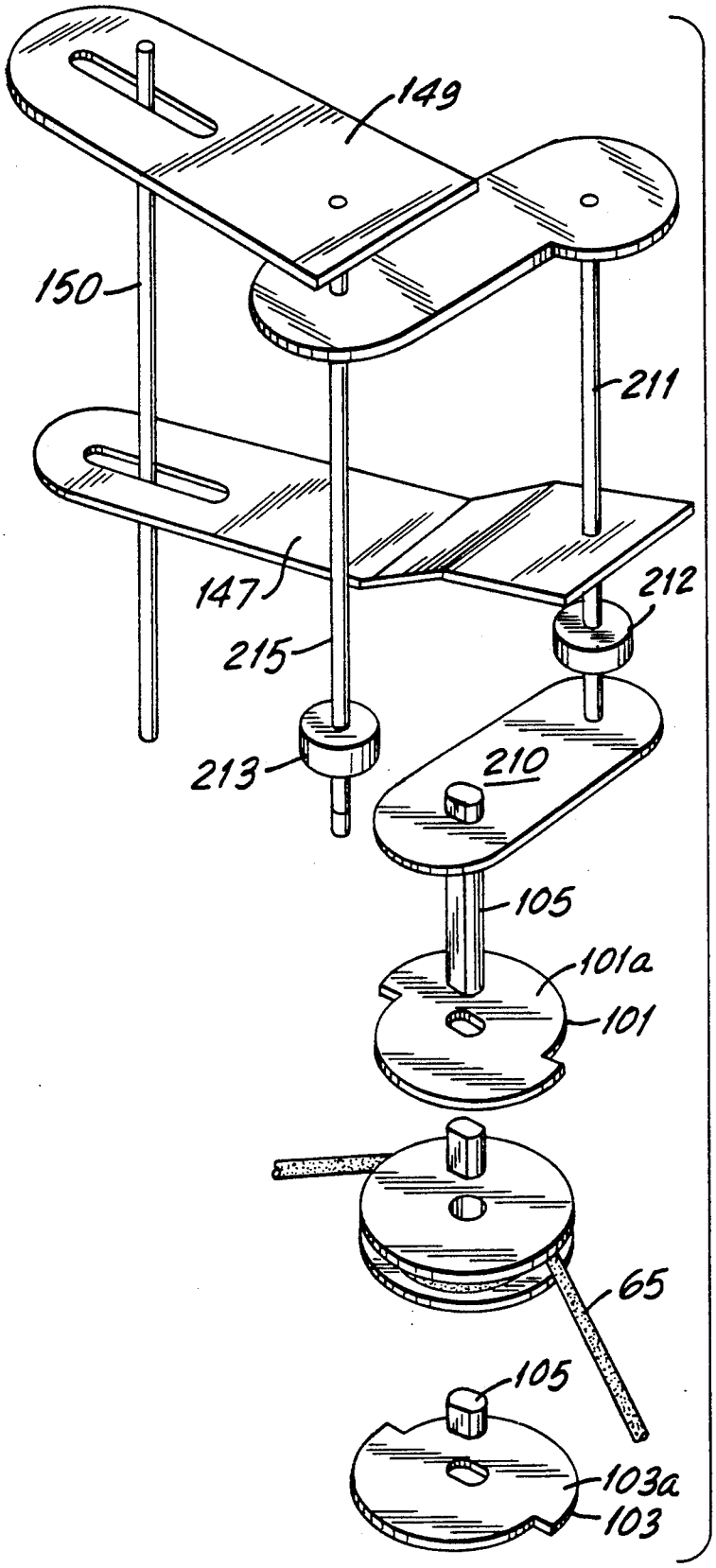
FIG. 13 is a perspective view of the turret driving mechanism illustrating the operation of the rams.

In FIG. 8, a sample package is shown at the point of ejection from the bottom opening in the sample containing chute 29, the chute being shown partly in cutaway section to illustrate the lower oscillating sample ejector ram 147 and the upper oscillating sample ejector ram 149. The rams 147, 149 are interconnected by means of linkage on shaft 105 which is illustrated in FIG. 13 and which allows the rams 147, 149 to reciprocate freely as the shaft 105 pivots. The linkage rollers 213 and 212 cause the turret to advance approximately 30 degrees as the rams rotate 180 degrees.

The apparatus of this invention and its operation will now be described with particular reference to FIGS. 9–13. Although the operation and the use of the apparatus will be described for the best mode now contemplated, it must be understood that this description is not intended to limit the scope of the invention, but rather it is illustrative of the apparatus and its operation. Also, for the sake of illustration, the apparatus and its operation will be described in connection with dispensing sample packages, or simply samples of packaged products for use or try out by consumers.

Figure 9A:
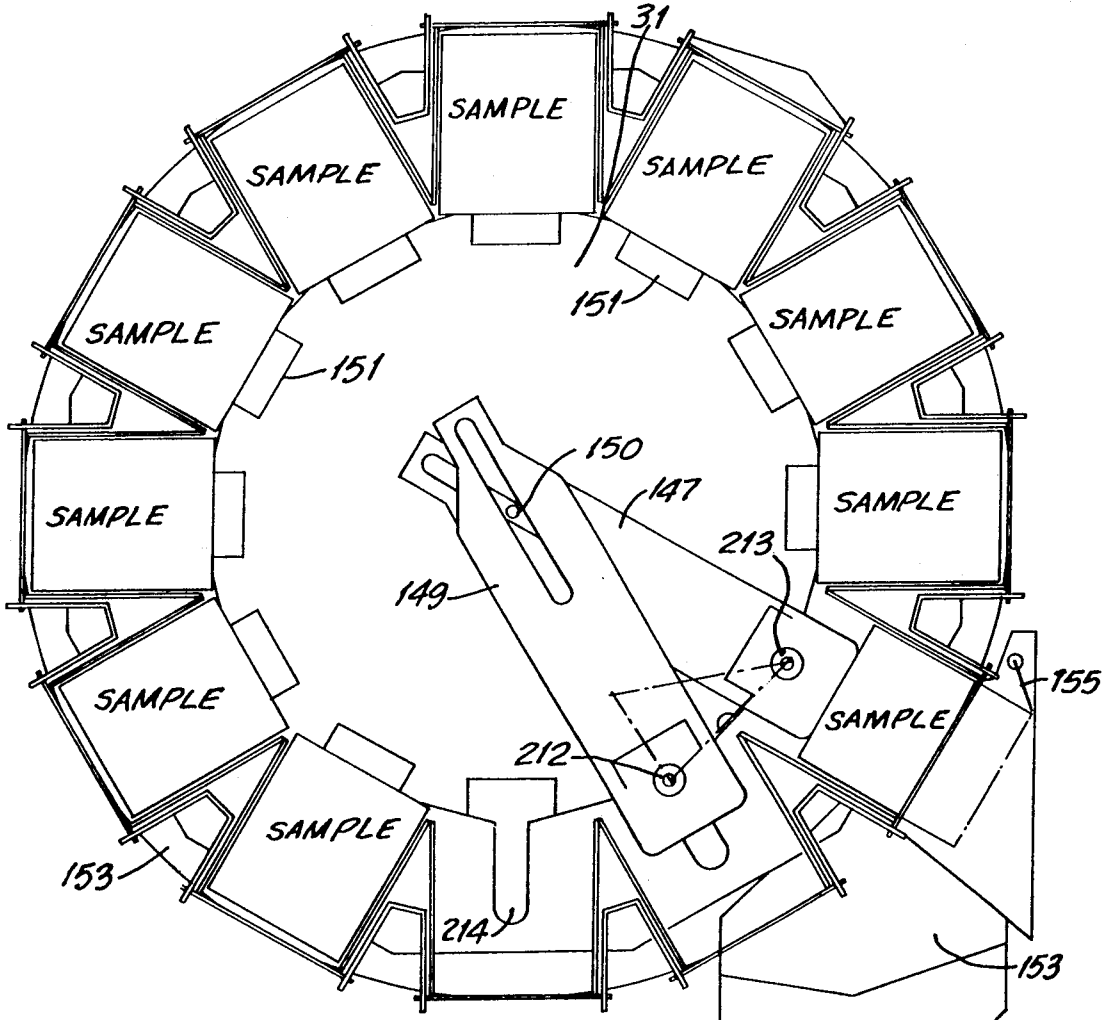
FIGS. 9A, 9B, 9C and 9D are schematic sectional top views of the turret illustrating a cycle during rotation of the turret in the sample dispensing operation of the apparatus of this invention and showing the operation of the two reciprocating rams.

Thus, referring first to FIGS. 9A, 9B, 9C and 9D, FIG. 9A illustrates the beginning of a vend (dispensing) cycle showing the turret with only the last ten samples not yet vended in order to illustrate the mechanism of the operation more clearly. As shown in FIG. 9A, twelve sample-containing chutes 29 are circumferentially arranged about the turret base plate 31, with each chute 29 typically containing 33 vertically stacked 3×3 samples. Each sample is held in position by the inner containment channel 151 and each chute 29 is open at the bottom. The cpening is sufficiently large to allow only the lowermost sample to escape to the outside of the turret. The turret support table 87 has an opening 121. Each inner containment channel 151 extends from the top of the turret base plate 31 to a point slightly above the oscillating rams 147, 149, but slightly below the upper surface of the sample in order to prevent the sample from falling inside the turret, while allowing free movement of the rams below them. In this position, the next sample that will be dispensed is pushed by the lower oscillating ram 147 off the turret base plate 31 by said lower oscillating ram 147 out and over a staging ramp 153 which is located underneath the turret base plate 31. The sample indicator wire 155 pivots in counterclockwise direction. The trap door opening 121 (see FIG. 8) is open (see FIGS. 10A through 10D), the upper oscillating ram 147 is pulled slightly out from under the sample which was adjacently above the sample which was immediately dispensed.

The turret is prevented from rotating by the turret advancing rollers 212 and 213 (see FIG. 9A) which are located under the oscillating rams as both rollers are engaged in the turret slots simultaneously.

Figure 9B:
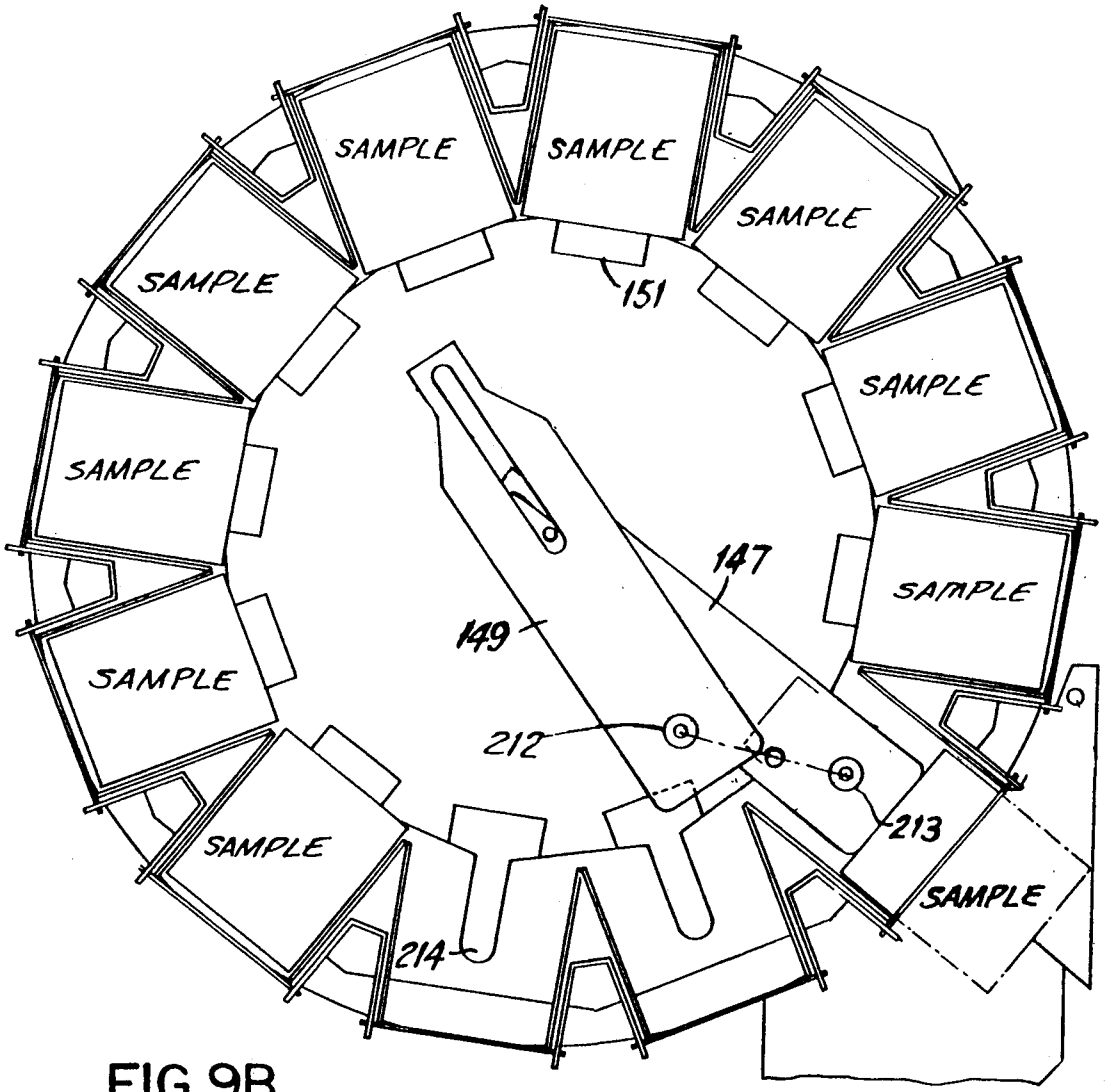

FIG. 9B shows the driver mechanism advanced 58 degrees clockwise. At this stage of operation, the lower ram 147 has pushed the sample almost off the turret base plate 31 as the sample drops to the staging ramp and the adjacently above sample begins to drop onto said ram 147. The upper ram 149 is now fully escaped from the chute. The lower ram roller entering the turret table slots has now rotated the turret 8.4 degrees clockwise and the trap door 115 has closed (see FIGS. 10A–10D). The sample has also rotated with the turret and therefore it is partly off the staging ramp but not yet dropped from the staging ramp to the opening 121 below the ramp.

Figure 9C:
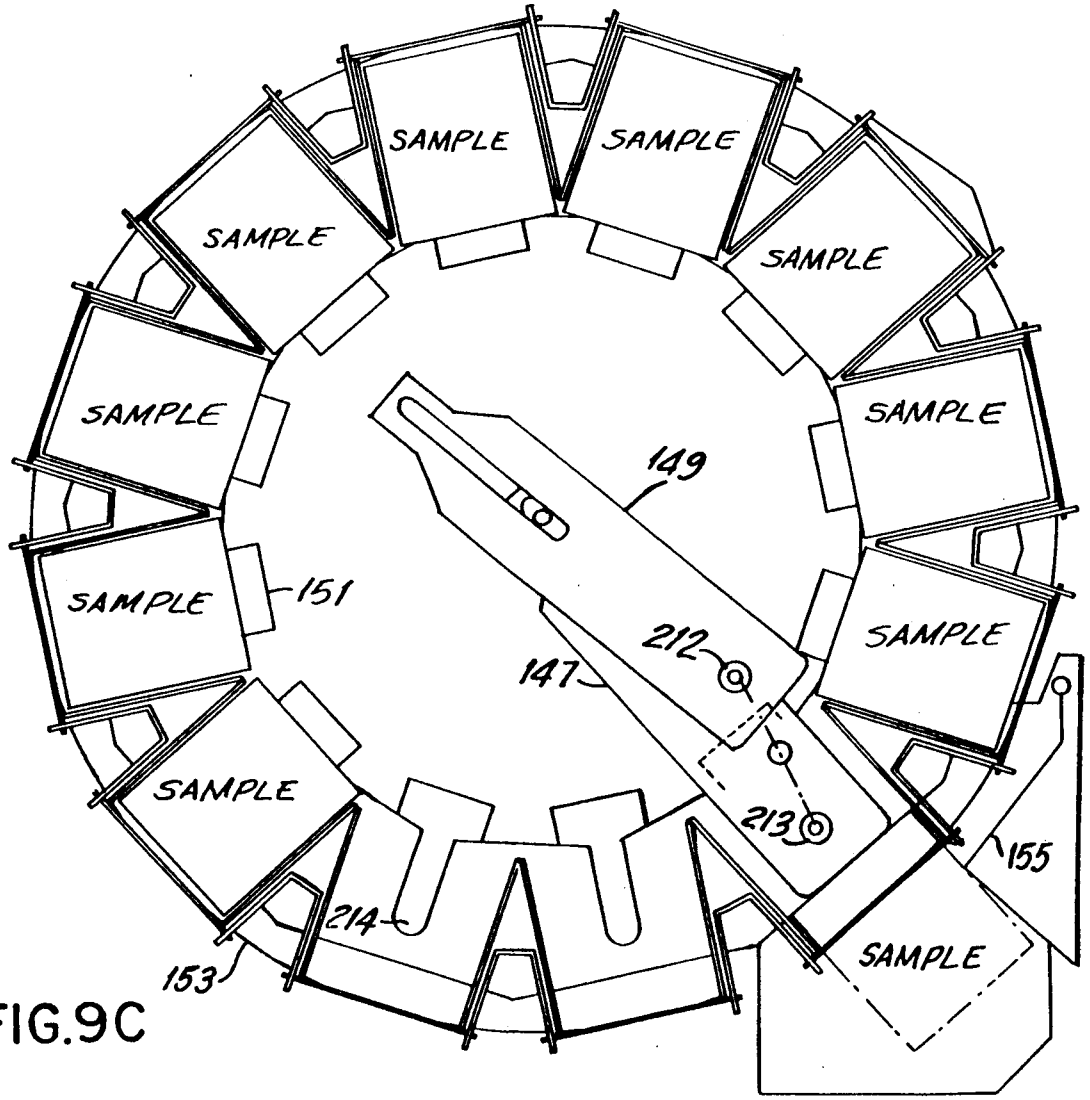

In FIG. 9C, the driver mechanism has rotated approximately 106 degrees clockwise and the sample is pushed and dropped off the turret by the ram 147 which is extended beyond the edge of the turret base plate 31. Thus, the sample has been pushed off of the staging ramp 153 and through the opening 121 of the turret plate 31 and rests on the trap door 115. The next sample has dropped on top of the lower ram 147 as the upper ram 149 approaches the next sample, with the turret having turned approximately 18.4 degrees clockwise by this stage. The sample indicator wire 155 is pivoted clockwise by an internal spring (not shown) and is caught by the next sample. If the mechanism is empty, however, the sample indicator wire 155 will rotate further and close the micro-switch 64 in order to illuminate the "empty" display.

Figure 9D:
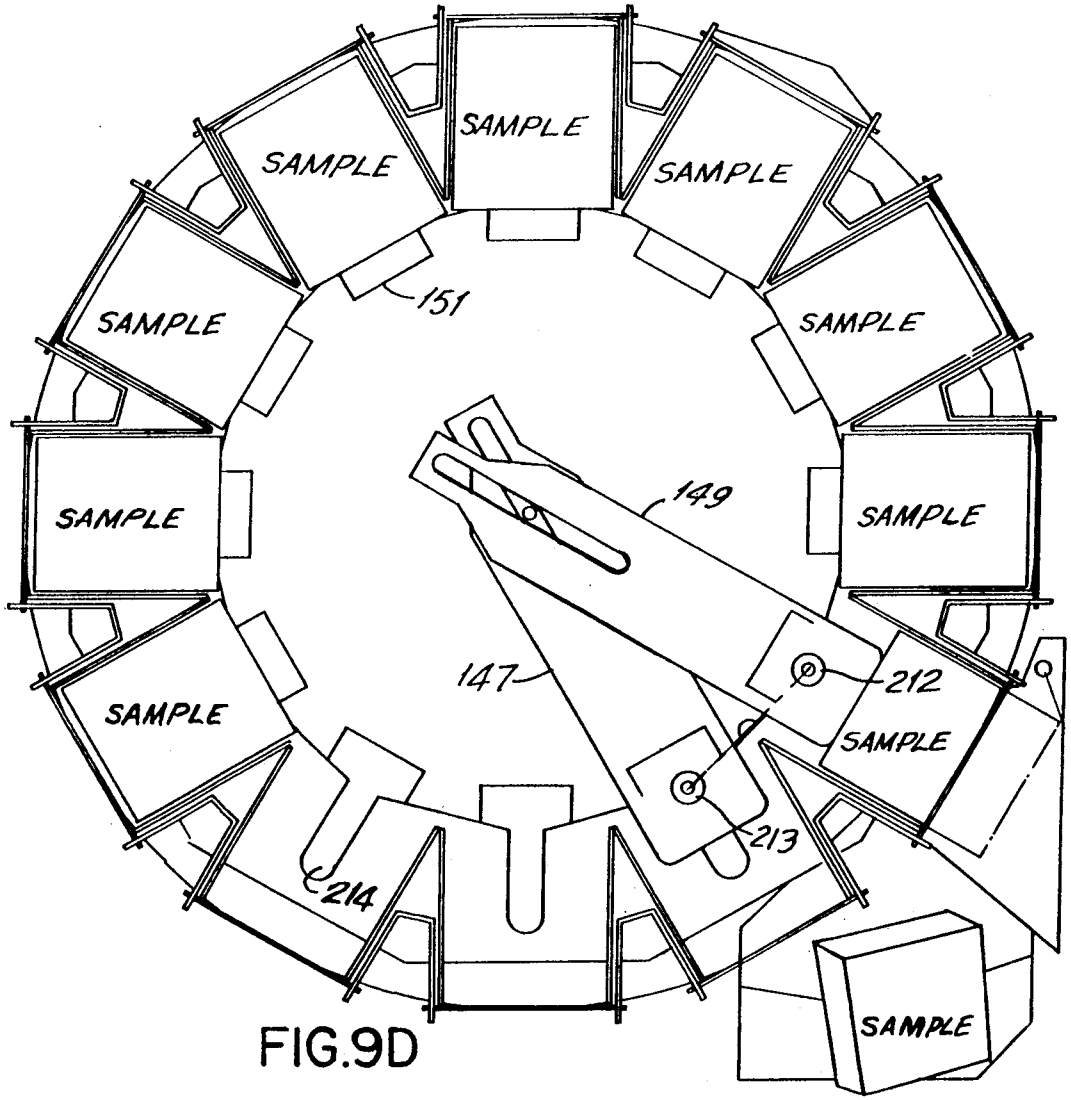

In FIG. 9D, the driver mechanism has been rotated a full 180 degrees with the turret having rotated 30 degrees clockwise. Trap door 115 opens, the sample thus falls into the sample receptacle 123 wherefrom it may be retrieved by the customer. The relative positions of the rams are now reversed by reciprocating motions about their common central control bushings and the cycle can be repeated upon pulling down the operating handle which has, by now, returned to its initial position.

It must be pointed out that the upper faces of the rams 147, 149 remain parallel to the inner face of the sample package on which they act due to the sliding motions of the two rams relative to each other over the central control pin 150.

While FIGS. 9A–9D describe the different steps of operation at various degrees of rotation, in actual operation, upon pulling down the operating handle 15, the entire operation proceeds in a smooth continuous cycle. The turret wheel 37 is both supported and permitted to rotate by rollers (not shown) circumferentially mounted underneath the turret wheel.

Figure 10B:
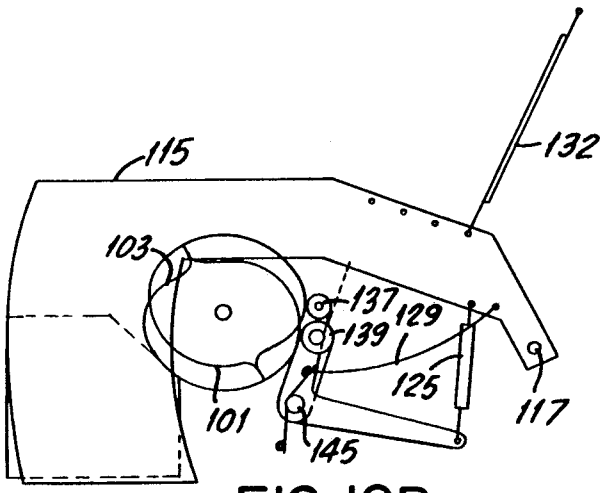
FIGS. 10A, 10B, 10C and 10D are top plan views illustrating the different cam effects during activation of the cam and dispensing of the sample.
Figure 10D:
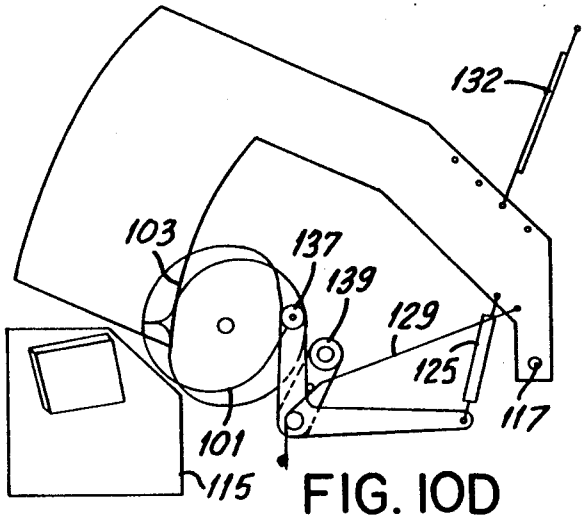
Figure 10A:
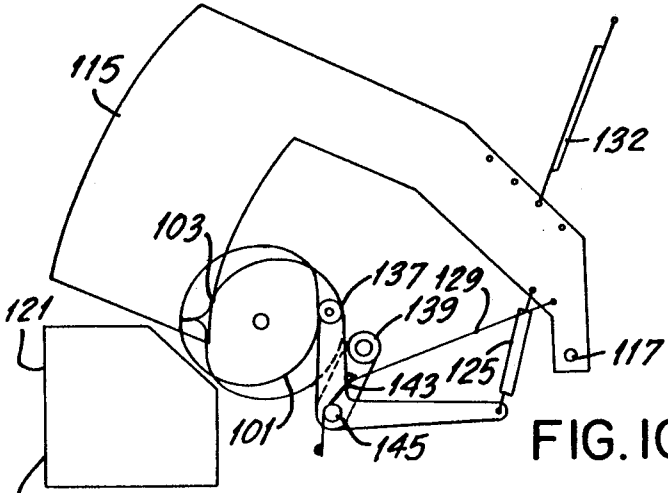

The operation of the cams 101 and 103 and their associated mechanisms to open and close the trap door 115 is illustrated in FIGS. 10A–10D. At the beginning of the cycle, as shown in FIG. 10A, the trap door 115 is fully open by the action of the light coil return spring 132. The door closer lever 143 is fully rotated in a counterclockwise direction about the stationery pivot 145 and the roller 137 rests against the valley portion of the cam 101. The positive stop lever 128 and the insulated roller 139 are held away from the cam 103 by the spring wire link 129 (see FIG. 7). Heavy spring 125 is at static length and is not extended. This spring may be considered a solid link since it will only extend if an obstruction prevents the swinging trap door 115 from closing fully thereby jamming the mechanism.

In FIG. 10B the shafts and the cams have rotated 58 degrees clockwise. The roller 137 is now at the highest point of the cam 101 and will remain at this position until the end of the cycle when, once again, it drops to its lowest position as shown in FIG. 10A. The spring 125 and the door closer lever 141, 143 move clockwise and pulls down the trap door 115 about the stationery pivot 117 to fully close the door before the sample is pushed from the turret into the opening 121 (see FIG. 8). The light spring 132 is now in an extended position.

Figure 10C:
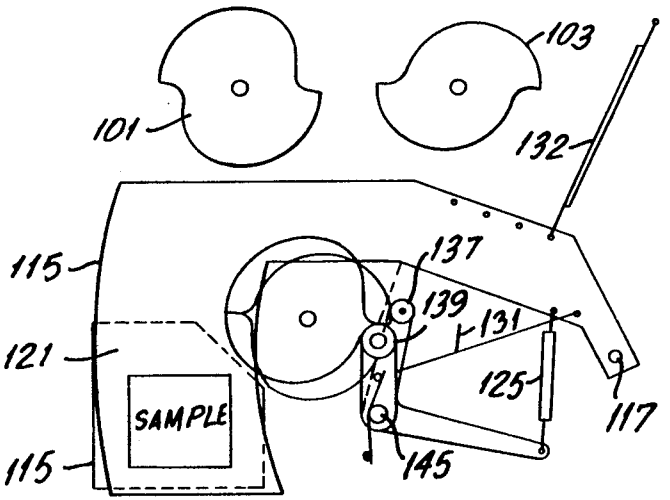

In FIG. 10C, the cams have rotated 180 degrees clockwise. The roller 139 has followed the contour of cam 103 to its lowest point by the action of the hairpin spring 129 and thus interrupts rotation of the cams immediately after the roller 137 has dropped off the high point of the cam 101 as shown in FIG. 10D, which shows the cams 101, 103 and their respective shafts rotating at 180 degrees, and the door closer lever 143 returned to its original position in FIG. 10A as the trap door 115 is opened by the light spring 132 and the sample thus drops into the sample receptacle chute 24 where it can be retrieved by the customer.

The above cycle is repeated each time the operating handle 15 is pulled down, triggering another 180 degrees of rotation of the cams and resulting in dispensing the next sample package.

As it was previously mentioned, one novel feature of the sample dispenser of this invention is that it includes a time—delay mechanism so that a predetermined time of about say 25–30 seconds lapses after vending each sample before the next sample can be dispensed. Although time delay mechanisms are generally known, one such system for use in the present apparatus is illustrated in FIGS. 11A to 11D and will now be described.

Figure 11A:
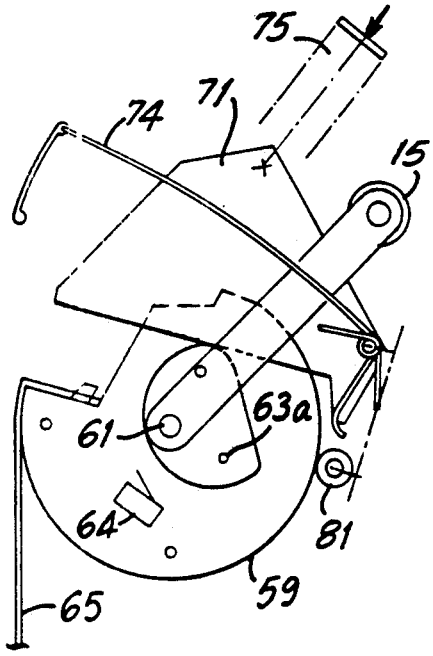
FIGS. 11A, 11B, 11C and 11D are side plan views illustrating the timer mechanism used in the apparatus of this invention for time delay between dispensing successive samples.
Figure 11B:
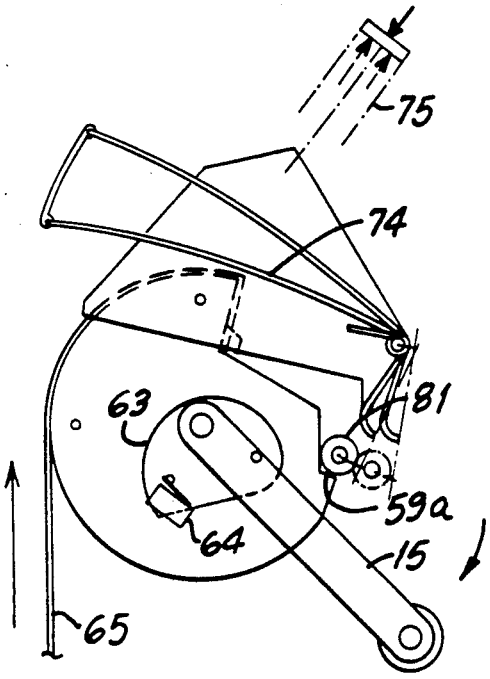
Figure 11C:
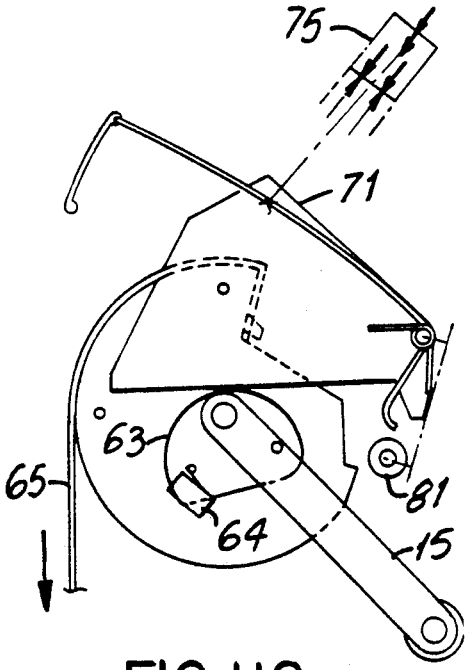
Figure 11D:
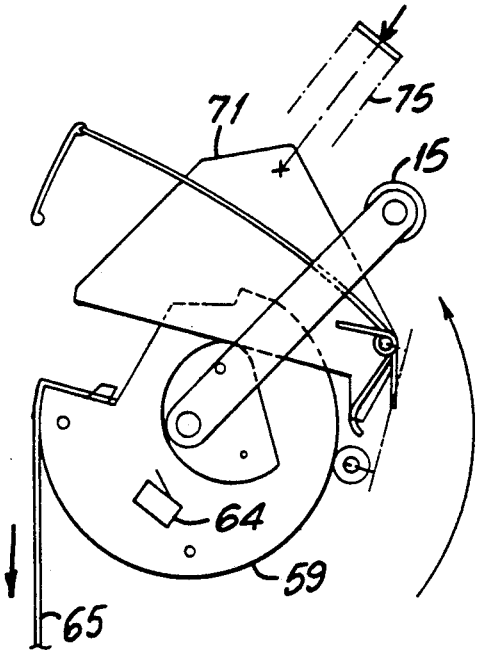

FIG. 11A illustrates the relative positions of the operating handle 15, the pulley 59, the cam 63, the weight plate 71, the air pot 75, the link wire 74 and the timer roller 81 before a customer pushes down the operating handle 15. As handle 15 is pushed down in a clockwise direction (see FIG. 11B), it will rotate the cam 63 and the plate 59 in the clockwise direction and the timer roller 81 will assume the position shown in FIG. 11B against the face 59*a* of plate 59. Clockwise rotation of the plate 59 causes the cable 65 to be pulled in the clockwise direction. In the meantime, the weight plate 71 has been separated from and is no longer in contact with the cam 63 and the microswitch 64 is operated by pin 63*a* on the cam 63. As the air pressure in the air pot 75 equalizes, the weignt plate 71 descends slowly upon the cam 63. The roller 81 is rotated by the weight plate 71 until the timer roller 81 escapes from the face 59*a* of pulley 59 (see FIG. 10C). After 25–30 seconds, the operating handle 15 will return to its initial position, ready for the next vending cycle (see FIG. 11D). Meanwhile, cable 65 will be released in the counterclockwise direction to return the driving mechanism to its initial cycle. The pulley 59 is then pulled counterclockwise by cable 65 (from FIG. 11C position to FIG. 11D position) which turns the cam 63, relifting the weight plate 71 and resetting the timer mechanism. FIG. 11B illustrates the timer off-on lever 74. In the timer off position roller 81 is held away from the pulley 59 so the handle 15 may return immediately for quicker loading of the turret.

Figure 12:
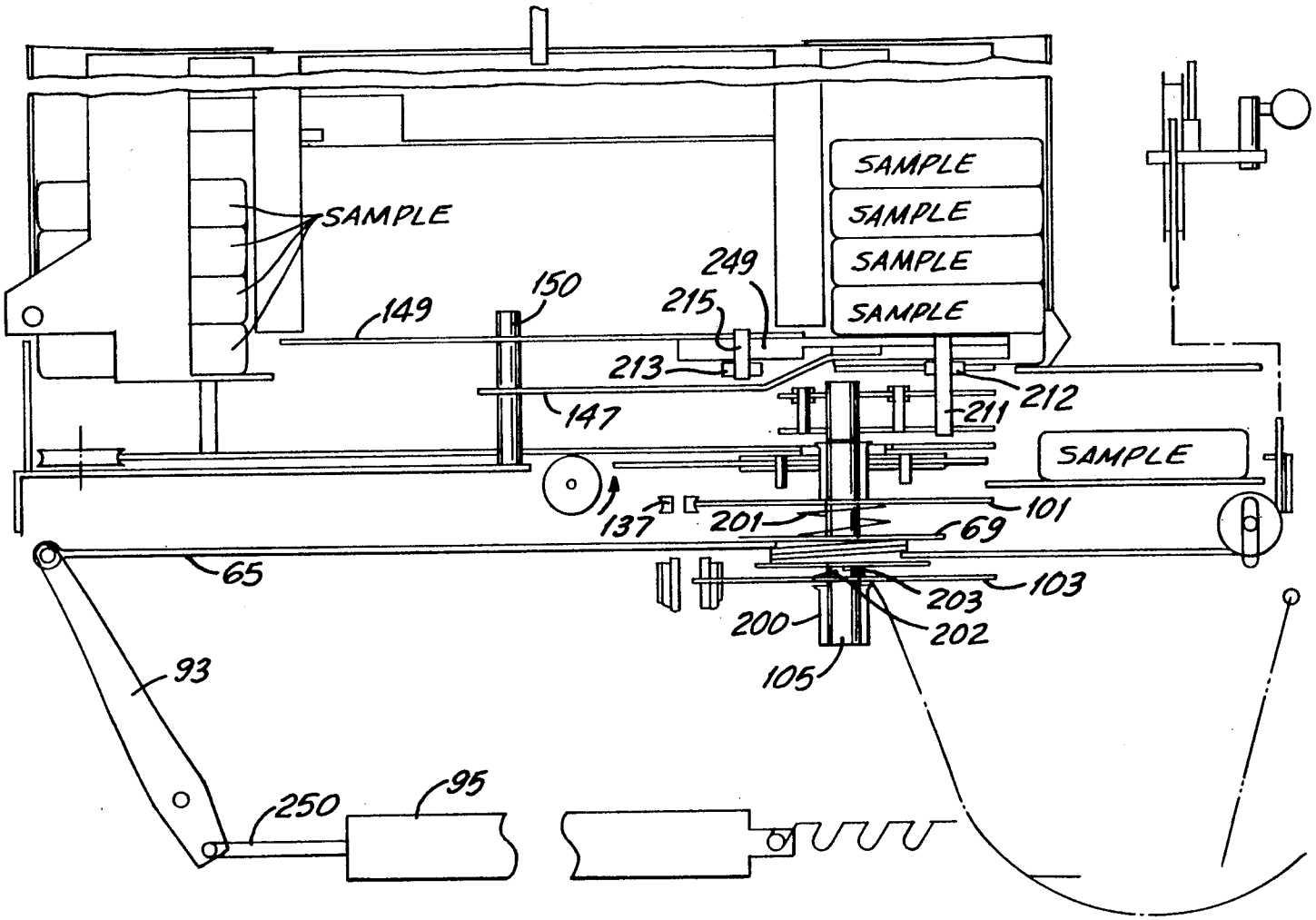
FIG. 12 is a side cross sectional view of a portion of the turret drive mechanism and the rams used to eject the package samples.

In FIG. 12, the rotatable shaft 105 (driver shaft) is shown mounted rotatably within the support bushing 200. The cam 103 has protruding 180 degrees ratchet teeth 202 on its upper face which mesh with the protruding driving 180 degrees ratchet teeth 203 in the bottom face of the cable spool 69. This forms a one-way ratchet clutch mechanism so that clockwise motion (as seen from the top) of the cable spool 69 rotates the cam 103, but the counterclockwise motion of the cable spool 69 does not move the cam 103. Thus, the cable spool 69 slides over the cam 103 during its counterclockwise rotation. The cams 101 and 103 are fixed to the driver shaft 105. However, the cable spool 69 is not fixed to this shaft but rather, is freely mounted rotatably thereon. A coil spring 201 is held between the top of the cable spool 69 and the bottom of the cam 101 and urges the cable spool 69 downwardly against the cam 103.

Also seen in FIG. 12, the ram 149 is connected to the driver shaft 105 via arm 210, shaft 211 cross link 249 and pivot 215 so that the rotary movement of the driver shaft pivots the ram clockwise a given angle. The orbiting shaft 211 drives the lower ram 147. A pin 150 connects the lower ram 147 and the upper ram 149 and drives the lower ram 147.

The turret is rotated by the rollers 212 and 213 which are inserted, in sequence, one after the other, in successive elongated slots 214 of the turret support plate 31 (see FIGS. 9A–9D). The ram, along with the inserted roller, is turned 180 degrees (for a 12 chute turret) while turning the turret support plate 30 degrees.

While the present dispenser has been described with certain degrees of particularly, it must be understood that this description is for the purpose of illustration only and is not intended to be limiting in any way. Several changes and modifications will suggest themselves to a person skilled in the art which are obvious from the description and, therefore, such changes and modifications are within the scope and contemplation of this invention.

We claim:

1. An article dispensing apparatus which comprises:

(a) a frame, a protective housing mounted on said frame and an outlet chute for said article;

(b) a turret having an axis rotatably mounted on said frame to rotate about said axis, said turret including a plurality of vertically aligned channel members circumferentially arranged about said axis, each channel member adapted to hold a vertical stack of said articles, including a bottom article;

(c) a hand-operated handle mounted on said frame and protruding exteriorly of said housing, said handle adapted to be operated by a user;

(d) means operated by said handle to rotate said turret a partial turn so as to align a channel member with said outlet chute, and (e) ram means comprising two members reciprocally mounted to reciprocate upon operation of said handle, and ram operating means to drive one of said ram members outwardly from said axis to eject an article from a first channel member and then, on the next operation of said handle, to drive the other ram member from said axis to eject a second sample from a second channel member.

2. An apparatus as in claim 1 further including a timing means to provide a predetermined delay between dispensing of each article.

3. An apparatus as in claim 1 wherein said means to rotate the turret comprises a cam plate operatively connected to said operating handle and having an initial normal position; a cable connected to said cam plate; a return spring means connected to said cable to exert force on said cable to return the cam plate to the normal position of the cam plate; a pulley rotatable by and connected to said cable; a pulley shaft connected to said pulley; and drive means driven by said pulley shaft for rotating said turret.

4. An apparatus as in claim 2 wherein said means to rotate the turret comprises a cam plate operatively connected to said operating handle and having an initial normal position; a cable connected to said cam plate; a return spring means connected to said cable to exert force on said cable to return the cam plate to the normal position of the cam plate; a pulley rotatable by and connected to said cable; a pulley shaft connected to said pulley; and drive means driven by said pulley shaft for rotating said turret.

5. An apparatus as in claim 1 further including said chute positioned below the turret to direct the article ejected from the channel member, and a receptacle for receiving the ejected article to be retrieved by the user.

6. An apparatus as in claim 2 further including said chute positioned below the turret to direct the article ejected from the channel member, and a receptacle for receiving the ejected article to be retrieved by the user.

7. An apparatus as in claim 3 further including said chute positioned below the turret to direct the article ejected from the channel member, and a receptacle for receiving the ejected article to be retrieved by the user.

8. An apparatus as in claim 4 further including said chute positioned below the turret to direct the article ejected from the channel member, and a receptacle for receiving the ejected article to be retrieved by the user.

9. An apparatus as in claim 1 wherein each of said channel members has a manual operated means retaining said channel member in a vertical alignment and is releasable to pivot said channel member to a non-vertical alignment adopted to load said channel member with a stack of articles.

10. An apparatus as in claim 2 wherein each of said channel members has a manual operated means retaining said channel member in a vertical alignment and is releasable to pivot said channel member to a non-vertical alignment adopted to load said channel member with a stack of articles.

* * * * *